US006706206B1

(12) United States Patent
Aichele et al.

(10) Patent No.: US 6,706,206 B1
(45) Date of Patent: Mar. 16, 2004

(54) MOULDABLE MATERIAL AND METHOD FOR PRODUCING A WEAKLY MAGNETIC COMPOSITE MATERIAL THEREWITH

(75) Inventors: Wilfried Aichele, Winnenden (DE); Hans-Peter Koch, Stuttgart (DE); Andreas Harzer, Schwieberdingen (DE); Torsten Bober, Renningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/856,763

(22) PCT Filed: Sep. 6, 2000

(86) PCT No.: PCT/DE00/03054

§ 371 (c)(1),
(2), (4) Date: Sep. 7, 2001

(87) PCT Pub. No.: WO01/22448

PCT Pub. Date: Mar. 29, 2001

(30) Foreign Application Priority Data

Sep. 23, 1999 (DE) ..... 199 45 619

(51) Int. Cl.[7] ..... H01F 41/02
(52) U.S. Cl. ..... 252/62.54; 252/62.55
(58) Field of Search ..... 252/62.54, 62.55

(56) References Cited

U.S. PATENT DOCUMENTS 3,184,807 A * 5/1965 Schornstheimer et al. . 49/478.1
4,308,155 A * 12/1981 Tada et al. ..... 252/62.54
4,626,371 A * 12/1986 Ikenaga et al. ..... 252/62.54
5,376,291 A * 12/1994 Watanabe ..... 252/62.54
5,888,416 A * 3/1999 Ikuma et al. ..... 252/62.54
6,039,784 A * 3/2000 Luk ..... 75/231
6,102,980 A * 8/2000 Endo et al. ..... 75/252

FOREIGN PATENT DOCUMENTS

| | | |
|---|---|---|
| DE | 197 35 271 | 2/1999 |
| DE | 199 45 619 | 4/2001 |
| EP | 0 760 523 | 3/1997 |
| JP | 04 044 304 | 2/1992 |

* cited by examiner

*Primary Examiner*—C. Melissa Koslow
(74) *Attorney, Agent, or Firm*—Kenyon & Kenyon

(57) ABSTRACT

A compression-molding material, in particular for producing a magnetically soft composite, including a raw powder exhibiting magnetically soft properties, a thermoplastic compound, and a lubricant. The lubricant is especially stearic acid. The compression-molding material is used to produce a magnetically soft composite, whose manufacture includes the method steps of preparation of the compression-molding material, molding of the compression-molding material at a temperature below the melting point of the thermoplastic compound, first thermal treatment of the molded compression-molding material at a temperature below the melting point of the thermoplastic compound, and second thermal treatment of the molded compression-molding material at a temperature above the melting point of the thermoplastic compound. The magnetically soft composite is suitable for manufacturing heat-deformation-resistant, corrosion-resistant, and fuel-resistant, magnetically soft components for high-speed controllers and actuators.

13 Claims, No Drawings

MOULDABLE MATERIAL AND METHOD FOR PRODUCING A WEAKLY MAGNETIC COMPOSITE MATERIAL THEREWITH

FIELD OF THE INVENTION

The present invention relates to a compression-molding material and a method for producing a softly magnetic composite, using such a compression-molding material.

BACKGROUND INFORMATION

Magnetically soft composites are needed for producing temperature-, corrosion-, and solvent-resistant, magnetic component parts, particularly in electromechanics. In this context, these magnetically soft composites, and the component parts produced using them, need to have certain properties: They should have a high magnetic permeability, a high magnetic saturation, a low coercive field strength, and a specific electrical resistance that is as high as possible. The combination of the mentioned magnetic properties with a specific electrical resistance produces high switching dynamics with low eddy current losses, meaning that such a component part is magnetically saturated and demagnetized within a short time.

A magnetically soft, malleable composite and a method for producing it were already suggested in German Patent Application No. 197 35 271 A1, wherein a powder having magnetically soft properties is coated with a thermoplastic compound, and subsequently is pressed into a molded article. The molded article or the formed compression-molding material is then subjected to heat treatment, which is in an atmosphere of inert gas, and exceeds the melting point of the thermoplastic compound.

In addition, it is already known that non-alloyed or alloyed iron powder can be axially compression-molded with thermoplastic resins, such as epoxides or phenolic resins.

SUMMARY OF THE INVENTION

In comparison with the related art, the compression-molding material of the present invention and the method of the present invention for producing a magnetically soft composite, using such a compression-molding material, have the advantage that the temperature that was required until now while molding the compression-molding material in a compression-molding die, for example, in a bottom die, can be lowered. At the same time, one can dispense with preheating the compression-molding material prior to molding it. The improved sliding behavior of the compression-molded material also allows the portion of thermoplastic compound in the compression-molded material to be reduced.

Furthermore, the compression-molding material of the present invention allows higher material densities to be attained at a given compression force, and reduces the tool wear. Dispensing with the preheating of the compression-molding material prior to molding prevents undesired oxidation, e.g. of iron powder as a starting powder having magnetically soft properties.

In the method according to the present invention, the lowering of the mold temperature also illuminates the need to mold in the compression-molding die, in the presence of inert gas.

Finally, the compression-molding material according to the present invention and the method according to the present invention have the advantage of the processing being easier due to the considerably simplified hot-pressing device, as well as the lower energy consumption during the molding.

Thus, the magnetically soft composite, or component parts, are advantageously produced using this composite, by uniaxially pressing the compression-molding material in a female mold, at temperatures lower than the melting temperature of the thermoplastic compound added to the compression-molding material; and by subsequently subjecting the compression molding material to a stepped, thermal aging process.

In this aging process, the added lubricant is initially evaporated or pyrolyzed at temperatures below the melting temperature of the thermoplastic compound, and subsequently, the thermoplastic compound is melted by increasing the temperature further. In this connection, the melted, thermoplastic compound wets the powder particles of the raw powder having the magnetically soft properties, and therefore, effectively bonds the powder particles after cooling. This results in the attained composite having a high mechanical strength and a high electrical resistance.

The compression-molding material of the present invention, which is used as a starting material for the method of the present invention for producing the magnetically soft composite, starts out from a magnetically soft powder that is either coated on the surface by a thermoplastic compound, or is alternatively dry-mixed with a fine thermoplastic powder. To that end, the powder particles can be coated by the thermoplastic compound, e.g. by adding a solution of a suitable thermoplastic polymer in a solvent.

In the case of dry-mixing the thermoplastic compound with the magnetically soft powder, a powdery, thermoplastic compound is used which preferably has an average particle size of 1 $\mu$m to 100 $\mu$m, and especially 5 $\mu$m to 40 $\mu$m.

As a means of lubrication, a lubricant is used which evaporates, or else thermally decomposes and volatizes, in response to the compression-molding material being heated in an atmosphere of inert gas, during the two-stage, thermal aging process, at temperatures below the melting point of the applied thermoplastic compound. Neither the lubricant nor its decomposition products react chemically with the thermoplastic compound and/or the raw powder having the magnetically soft properties.

In order to prevent the molten thermoplastic from being expelled from the composite due to the pressure of the gases originating from the lubricant, it is also very advantageous, after molding at temperatures below the melting point of the thermoplastic compound, to first remove the lubricant, at least almost completely, from the compression-molding material before the thermoplastic compound is then melted by a further temperature increase, and the magnetically soft, raw powder is wetted.

So, on the whole, a considerable increase in the strength of the lubricant-free composite due to the formation of adhering polymer bridges occurs in response to the compression-molding material, or the component part produced from it, cooling off.

In addition, the lubricant is advantageously prevented from remaining in the structure of the attained, magnetically soft composite, and from negatively influencing its working properties there.

In view of the temperatures during molding and during the thermal aging process, the use of the lubricant stearic acid, which is also used simultaneously as a mold release agent, has proved to be advantageous. For this purpose, the stearic acid is advantageously added to the compression-molding material as a micronized powder having an average particle size of 1 μm to 100 μm, and especially 10 μm to 50 μm.

Several polymers are advantageously suitable as thermoplastic compounds, polyphenylene sulfide may be used. The combination of stearic acid with polyphenylene sulfide is particularly advantageous.

DETAILED DESCRIPTION

Initially, phosphated iron powder of the types ABM or Somaloy 500 (co. Höganäs, Sweden) is mixed, as a raw powder having magnetically soft properties, with polyphenylene-sulfide powder as a thermoplastic compound. The types of polyphenylene sulfide powder used include, for example, VO (co. Phillips Petroleum) or Fortron 0205 B4/20 (co. Ticona). Stearic acid is then added to this powder mixture, as a lubricant and mold release agent having an average powder-particle size of approximately 30 μm.

In particular, the lubricant stearic acid is added to the compression-molding material at a mass percentage of 0.05 to 1, and especially at a mass percentage of 0.1 to 0.3.

The thermoplastic compound is added to the compression-molding material at a mass percentage of 0.2 to 10, and especially at a mass percentage of 0.3 to 1.5.

Specifically, phosphated iron powder may be mixed with 0.6% polyphenylene-sulfide powder by mass and 0.2% micronized stearic acid by mass.

The compression-molding material, which is attained in this manner, is then molded into a component part at 70° C., in a female mold, without preheating the powder, using uniaxial compression. To this end, the compression-molding die was preheated to a temperature of 70° C.

After molding the compression-molding material in the female mold, it is then subjected to a two-stage aging process, which includes a first thermal treatment of the molded compression-molding material or molded component part at a temperature below the melting point of the applied thermoplastic compound, and a subsequent, second thermal treatment of the molded compression-molding material at a temperature above the melting point of the thermoplastic compound.

To this end, the first thermal treatment in the clarified embodiment is carried out for over two hours, at a temperature of 260° C., in an atmosphere of nitrogen. The second thermal treatment is then carried out at 285° C. to 300° C., for a time period of 30 minutes.

The selection of stearic acid ensures that this lubricant at least substantially volatizes in a residue-free manner, during the first heat treatment. In comparison with the utilized thermoplastic compound polyphenylene sulfide and the phosphated iron powder, this lubricant and its decomposition products are also at least chemically inert to a large extent, so that no chemical reaction occurs between the lubricant and the other components of the compression-molding material during the heat treatment.

Prior to molding, the compression-molding material can, on one hand, be prepared by mixing the iron powder having the magnetically soft properties with the powdery thermoplastic compound polyphenylene sulfide, as well as with the powdery lubricant stearic acid.

However, as an alternative, one can initially coat the iron powder exhibiting the magnetically soft properties with a thermoplastic compound, such as polyphthalamide, dissolved in a solvent; and subsequently or simultaneously mix the raw powder having the magnetically soft properties with the powdery lubricant, or introduce the lubricant dissolved in a solvent into the compression-molding material.

Reference is made to German Patent No. 197 35 271 A1 regarding further details about the processing of the compression-molding material prior to the actual molding operation in the compression-molding die, and regarding additional, suitable thermoplastic compounds. In particular, it should be emphasized that polyphtalamides can also be used as a thermoplastic compound.

Apart from pure iron powder, iron-nickel, iron-silicon, and iron-cobalt alloys are also suitable as a raw powder exhibiting magnetically soft properties.

To demonstrate the advantages of the compression-molding material according to the present invention, and the advantages of the method for producing a magnetically soft composite, using the compression-molding material, a comparative trial was run in which phosphated iron powder was mixed with 0.8 mass % polyphenylene-sulfide powder in accordance with the above-mentioned explanations. However, no lubricant was added to the compression-molding material.

In order for the reference specimen to attain magnetic and electrical properties comparable to those of the magnetically soft composite obtained in accordance with the present invention, it was necessary, in this case, to first preheat the powder to 130° C. in the presence of inert gas, prior to molding, and subsequently mold the compression-molding material at a mold temperature of 140° C. The compression-molding material was then subjected to a single-stage aging process, which included a thermal treatment at 285 to 300° C. for a time period of one hour, in an atmosphere of nitrogen.

Therefore, the addition of the lubricant according to the present invention eliminates the need to preheat the powder, and allows the mold temperature to be reduced considerably.

In addition, thermogravimetric tests (TGA analysis) and differential scanning calorimetry (DSC analysis) showed that the heating of the molded compression-molding material during the first heat treatment caused the lubricant stearic acid to evaporate, or at least to thermally decompose to large extent, and volatize.

Furthermore, the increased strength of the obtained component parts in comparison with parts produced at a mold temperature of 140° C. indicates, that neither the lubricant nor its decomposition products chemically reacted with the polyphenylene sulfide in a significant manner.

What is claimed is:

1. A compression-molding material for producing a magnetically soft composite comprising:

a raw powder exhibiting a magnetically soft property;

a thermoplastic compound; and a lubricant, wherein the lubricant has an average particle size of 1 μm to 24 μm.

2. The compression-molding material of claim 1, wherein the lubricant is a mold release agent.

3. The compression-molding material of claim 1, wherein the lubricant is stearic acid.

4. The compression-molding material of claim 1, wherein the raw powder is one of a phosphated iron powder, an iron-nickel powder, an iron-silicon powder, and an iron-cobalt powder.

5. The compression-molding material of claim 1, wherein the thermoplastic compound is one of:

added to the compression-molding material as a solution in a solvent, and added to the compression-molding material as a powder.

6. The compression-molding material of claim 5, wherein the thermoplastic compound is a powder, the powder of the thermoplastic compound having an average particle size of 1 $\mu$m to 100 $\mu$m.

7. The compression-molding material of claim 1, wherein the thermoplastic compound is polyphenylene sulfide.

8. The compression-molding material of claim 1, wherein the thermoplastic compound is added to the compression-molding material at a mass percentage of between 0.2 and 10.

9. The compression-molding material of claim 1, wherein the lubricant is added to the compression-molding material at a mass percentage of between 0.05 and 1.

10. The compression-molding material of claim 3, wherein the lubricant is micronized stearic acid.

11. The compression-molding material of claim 6, wherein the powder of the thermoplastic compound has an average particle size of 5 $\mu$m to 40 $\mu$m.

12. The compression-molding material of claim 8, wherein the thermoplastic compound is added to the compression-molding material at a mass percentage of between 0.3 and 1.5.

13. The compression-molding material of claim 9, wherein the lubricant is added to the compression-molding material at a mass percentage of between 0.1 and 0.3.

* * * * *